US011998818B2

(12) United States Patent
Degtyaryov et al.

(10) Patent No.: US 11,998,818 B2
(45) Date of Patent: Jun. 4, 2024

(54) HANDLE ASSEMBLY FOR A CURLING STONE

(71) Applicants: CANADIAN CURLING ASSOCIATION, Orleans (CA); WORLD CURLING FEDERATION, Altdorf (CH)

(72) Inventors: Vitaliy Degtyaryov, Winnipeg (CA); Michael Yudelevich, Winnipeg (CA)

(73) Assignees: CANADIAN CURLING ASSOCIATION, Orleans (CA); WORLD CURLING ASSOCIATION, Altdorf (CH)

( * ) Notice: Subject to any disclaimer, the term of this patent is extended or adjusted under 35 U.S.C. 154(b) by 0 days.

(21) Appl. No.: 17/197,768

(22) Filed: Mar. 10, 2021

(65) Prior Publication Data

US 2021/0339105 A1 Nov. 4, 2021

Related U.S. Application Data

(60) Provisional application No. 63/017,872, filed on Apr. 30, 2020.

(51) Int. Cl.
*A63B 67/14* (2006.01)

(52) U.S. Cl.
CPC ..... *A63B 67/14* (2013.01)

(58) Field of Classification Search
CPC ..... A63B 67/14; A63B 6/14
See application file for complete search history.

(56) References Cited

U.S. PATENT DOCUMENTS

| | | | | | |
|---|---|---|---|---|---|
| 3,507,498 | A * | 4/1970 | Hugh | A63B 67/14 | 473/587 |
| 3,736,505 | A * | 5/1973 | Sankey | H01R 13/53 | 324/133 |
| 3,944,228 | A * | 3/1976 | Olson | A63B 67/14 | 411/908 |
| 5,228,686 | A * | 7/1993 | Maleyko | A63B 43/06 | 273/DIG. 8 |

(Continued)

FOREIGN PATENT DOCUMENTS

| | | | | |
|---|---|---|---|---|
| CA | 3040223 | * 10/2012 | ..... | A63B 67/14 |
| CA | 3006829 | * 11/2018 | ..... | A63B 67/14 |

(Continued)

*Primary Examiner* — John E Simms, Jr.
(74) *Attorney, Agent, or Firm* — Ryan W. Dupuis; Kyle R. Satterthwaite; Ade & Company Inc.

(57) ABSTRACT

A curling handle assembly mounts on a stone body to form a curling stone. The assembly has a connector inserted into the top side of the stone body. A support body extends outwardly from the connector to clamp against the stone body using a fastener threaded through the stone body to the connector. A connector body joins a handle body to be gripped by a user spaced above the support body. An electronic assembly arranged for measuring a performance characteristic is received within cavities integrally moulded into the handle body, the connector body or the support body. A lower contact surface of the support body includes an annular potion at a periphery of the handle assembly that forms first contact of the support body with the top side of the stone body as the support body is clamped against the top side of the stone body by the threaded fastener.

15 Claims, 6 Drawing Sheets

(56) References Cited

U.S. PATENT DOCUMENTS

| | | | | | |
|---|---|---|---|---|---|
| 6,142,894 | A * | 11/2000 | Lee | A63B 43/06 | 473/570 |
| 10,118,696 | B1 * | 11/2018 | Hoffberg | B64C 39/001 | |
| 2003/0189318 | A1 * | 10/2003 | Clark | B62B 1/14 | 280/47.26 |
| 2019/0308076 | A1 * | 10/2019 | Holzner | A63B 43/002 | |
| 2019/0311622 | A1 * | 10/2019 | Birchenko | G08G 1/145 | |
| 2021/0134424 | A1 * | 5/2021 | Czaban | G16H 40/63 | |
| 2022/0133574 | A1 * | 5/2022 | Fleumer | A61G 17/08 | 27/1 |

FOREIGN PATENT DOCUMENTS

| | | | | |
|---|---|---|---|---|
| CN | 103157262 | * | 6/2013 | A63B 67/14 |
| EP | 2511809 | * | 10/2012 | G06F 3/0443 |

* cited by examiner

HANDLE ASSEMBLY FOR A CURLING STONE

This application claims the benefit under 35 U.S.C. 119(e) of U.S. provisional application Ser. No. 63/017,872, filed Apr. 30, 2020.

FIELD OF THE INVENTION

The present invention relates to a handle assembly for mounting on a stone body to form a curling stone for use in the sport of curling, and more particularly the present invention relates to a curling handle assembly incorporating electronics therein for measuring one or more performance characteristic relating to the use of the curling stone in the sport of curling.

BACKGROUND

In the sport of curling, various attempts have been made to measure performance characteristics related to use of a curling stone.

A curling stone typically comprises a stone body and a molded plastic handle releasably fastened onto a top side of the stone body by a threaded fastener inserted upwardly through the stone body from a bottom side of the stone body.

Some examples of measured performance characteristics include (i) measuring if a curling stone remains in contact with a player after the curling stone has traversed a hog line on the curling sheet during delivery, (ii) measuring a rotation rate of the curling stone, (iii) measuring a speed of movement of the curling stone along the sheet of ice, and/or (iv) measuring a position of the curling stone. In each instance, an electronic assembly including sensors and a circuit board must be mounted on the curling stone. This is typically accomplished by (i) putting a media with electronics and batteries within a very limited space between the stone and the handle which limits the type of electronics permitted, or (ii) modifying the curling handle, for example by drilling one or more cavities into the molded plastic handle of the curling stone to place electronics into the drilled cavities. Drilling into the plastic material of the handle however, disrupts the internal tension within the molded plastic material such that the structure of the handle is compromised. This commonly results in subsequent cracking or breaking of the handle.

Furthermore, the conventional molded plastic handle of a curling stone is shaped to somewhat match the shape of the top side of the curling stone and includes an internally threaded connector set into the plastic material. An elongate threaded fastener is inserted from the bottom of the curling stone to substantially fully span the height of the stone body for connection to the internally threaded connecter set in the plastic material of the handle at the top side of the stone body. Tightening the threaded connection clamps the plastic handle against the top side of the stone body. The handle is shaped so that it primarily clamps against the top side of the stone body in the region immediately surrounding the threaded connection. In order to generate sufficient friction to fix the orientation of the handle relative to stone body, the fastener requires a firmly tightened threaded connection such that it is known for the fastener to occasionally strip the threading within the connector of the handle or cause cracking in the plastic material of the handle. In either instance, the handle must be replaced.

SUMMARY OF THE INVENTION

The present invention provides a solution to some of the problems noted above to accommodate electronics, sensors and batteries into the handle, without requiring any addition to the handle or modification of the handle. Specifically, the curling handle assembly according to the present invention has integral cavities for placement of electronics and batteries so as to provide a complete solution for placement of electronics and battery power supply.

According to one aspect of the invention there is provided a curling handle assembly for mounting on a stone body to form a curling stone for use in a sport of curling, the stone body having a cylindrical peripheral surface, a running surface for sliding engagement on a sheet of ice at a bottom side of the stone body, a mounting surface on a top side of the stone body, and a mounting bore extending axially through the stone body between the top side and the bottom side of the stone body to receive a threaded fastener for clamping the handle assembly onto the top side of the stone body, the curling handle assembly comprising:

- a connector arranged to be inserted into the mounting bore at the top side of the stone body for mating connecting with the threaded fastener in a mounted position of the handle assembly;
- a support body extending outwardly from a top end of the connector and defining a lower contact surface for clamping against the mounting surface at the top side of the stone body in the mounted position of the handle assembly;
- a handle body arranged to be gripped in a hand of a user;
- a connector body joined between one end of the handle body and the support body so as to support the handle body in fixed relation to the support body;
- an electronic assembly arranged for measuring at least one performance characteristic relating to use of the curling stone and for communicating the measured characteristic externally to a user; and
- at least one cavity integrally moulded into one or more of the handle body, the connector body or the support body and receiving a portion of the electronic assembly therein.

By supporting the components of the electronic assembly within integrally moulded cavities within the handle assembly, the internal tension within the plastic material molded into the support body, connector body and handle body is undisturbed so as to optimize strength of the handle assembly even when electronics are mounted therein. This arrangement resists cracking and breakage which commonly occurs in conventional handles for curling stones which are modified to accommodate electronics therein.

The curling handle assembly may be further arranged such that (i) the electronic assembly includes a printed circuit board having a memory storing programming instructions thereon and a processor to execute the programming instructions stored on the member, and (ii) said at least one cavity includes a main cavity integrally molded in a bottom side of the support body and receiving the printed circuit board therein.

The curling handle assembly may be further arranged such that (i) the electronic assembly includes an embedded electrode in electrical communication with a conductive coating on the handle assembly for sensing a user touching the handle body, and (ii) said at least one cavity includes an electrode cavity integrally molded into one of the handle body or the connector body that receives the embedded electrode therein.

The embedded electrode may be embedded in plastic material of the connector body or the handle body such that the embedded electrode cannot be removed from the plastic material.

The curling handle assembly may be further arranged such that (i) the electronic assembly includes an indicator light arranged to communicate the measured characteristic externally of the curling stone, and (ii) said at least one cavity includes an indicator bore communicating through the support body in proximity to the connector body from an inner surface of the support body to an outer surface portion of the support body surrounding the indicator light, wherein the indicator light protrudes upwardly in relation to said outer surface portion of the support body. The outer surface portion of the support body that surrounds the indicator light may be substantially horizontal in orientation.

The curling handle assembly may be further arranged such that (i) the electronic assembly including at least one battery, and (ii) said at least one cavity including a battery cavity integrally molded into the support body and receiving said at least one battery therein. Said at least one battery may comprise a cylindrical shaped battery and wherein the battery cavity is arranged to receive said at least one battery therein such that the battery is readily releasable.

When the connector comprises an elongate body arranged to be received within the mounting bore of the stone body, the electronic assembly may include a sensor supported within a portion of the elongate body that is arranged to be inserted into the mounting bore of the stone body. The sensor may comprise a magnetic sensor and wherein the elongate body is formed of a rigid, non-ferromagnetic material.

The connector may comprise an elongate body arranged to be received within the mounting bore of the stone body so as to span a majority of a height the stone body between the top side and the bottom side thereof, in which the connector includes an internally threaded socket at a bottom end thereof for threaded connection to said threaded fastener for clamping the handle assembly onto the stone body.

The curling handle assembly may be further arranged such that (i) the lower contact surface of the support body including an annular portion that is annular in shape at a location spaced radially outward from the connector, and (ii) the annular portion of the lower contact surface being arranged so as to form a first contact of the support body with the top side of the stone body as the support body is clamped against the top side of the stone body by the threaded fastener in the mounted position. The annular portion of the lower contact surface may be located adjacent a peripheral edge of the support body. The lower contact surface may further include a central portion about the connector at a location spaced inwardly from the annular portion, the support body between the annular portion of the lower contact surface and the central portion of the lower contact surface undergoing a resilient flexion when the central portion of the lower contact surface engages the top side of the stone body. In this instance, a plurality of stiffener ribs may be formed on the support body to extend radially between the central portion of the lower contact surface and the annular portion of the lower contact surface at circumferentially spaced apart positions about the central portion.

The curling handle assembly may be further arranged such that (i) the electronic assembly includes a sensor circuit, a controller circuit, a battery, and an interrupt switch arranged to selectively interrupt connection of the battery to one or more of the controller circuit and the sensor circuit, (ii) an interrupt key is provided, (iii) said at least one cavity includes a key hole communicating through the support bottom between an interior side of the support body locating the interrupt switch thereon and an exterior side of the support body, (iv) the key hole is arranged to receive the interrupt key inserted therein such that the key is movable between an engaged position and a disengaged position relative to the interrupt switch, and (v) the interrupt switch is arranged to interrupt the connection between the battery and said one or more of the sensor circuit and the controller circuit in one of the engaged or disengaged positions of the interrupt key. The interrupt key may be slidably removable from the support body in the disengaged position, in which the interrupt switch is arranged to interrupt the connection between the battery and said one or more of the controller circuit and the sensor circuit in the engaged position of the interrupt key.

The electronic assembly may include a transmitting antenna received within said at least one cavity, in which the transmitting antenna is arranged to transmit a wireless signal receivable by two or more antennas associated with the sheet of ice so as to be arranged to track a position of the curling stone relative to a length and a width of the sheet of ice.

According to a second aspect of the present invention there is provided a curling handle assembly for mounting on a stone body to form a curling stone for use in a sport of curling, the stone body having a cylindrical peripheral surface, a running surface for sliding engagement on a sheet of ice at a bottom side of the stone body, a mounting surface on a top side of the stone body, and a mounting bore extending axially through the stone body between the top side and the bottom side of the stone body to receive a threaded fastener for clamping the handle assembly onto the top side of the stone body, the curling handle assembly comprising:

a connector arranged to be inserted into the mounting bore at the top side of the stone body for mating connecting with the threaded fastener in a mounted position of the handle assembly;

a support body extending outwardly from a top end of the connector and defining a lower contact surface for clamping against the mounting surface at the top side of the stone body in the mounted position of the handle assembly;

a handle body arranged to be gripped in a hand of a user; and a connector body joined between one end of the handle body and the support body so as to support the handle body in fixed relation to the support body;

the lower contact surface of the support body including an annular potion that is annular in shape at a location spaced radially outward from the connector; and the annular portion of the lower contact surface being arranged so as to form a first contact of the support body with the top side of the stone body as the support body is clamped against the top side of the stone body by the threaded fastener in the mounted position.

Use of an annular contact portion to engage the top side of the stone body at a location spaced outward from the central connecting fastener allows less clamping force to be used while still generating sufficient forces to resist rotation of the handle assembly relative to the stone body of a curling stone. This arrangement thus further resists potential for cracking and breakage of the plastic material forming the handle assembly.

When the lower contact surface further includes a central portion about the connector at a location spaced inwardly from the annular portion, the support body between the annular portion of the lower contact surface and the central portion of the lower contact surface are arranged to undergo a resilient flexion when the central portion of the lower contact surface engages the top side of the stone body.

A plurality of stiffener ribs may be formed on the support body to extend radially between the central portion of the lower contact surface and the annular portion of the lower contact surface at circumferentially spaced apart positions about the central portion.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
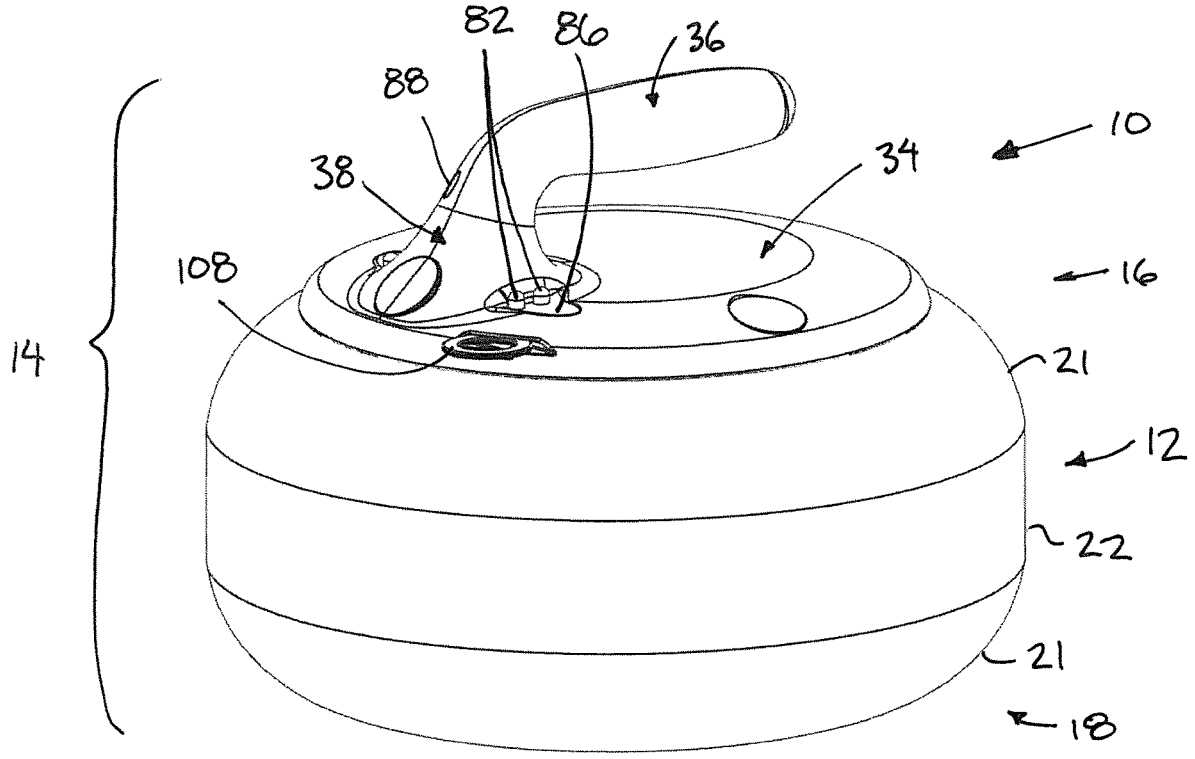
FIG. 1 is a perspective view of a curling stone with the curling handle assembly according to the present invention counted thereon.
Figure 2:
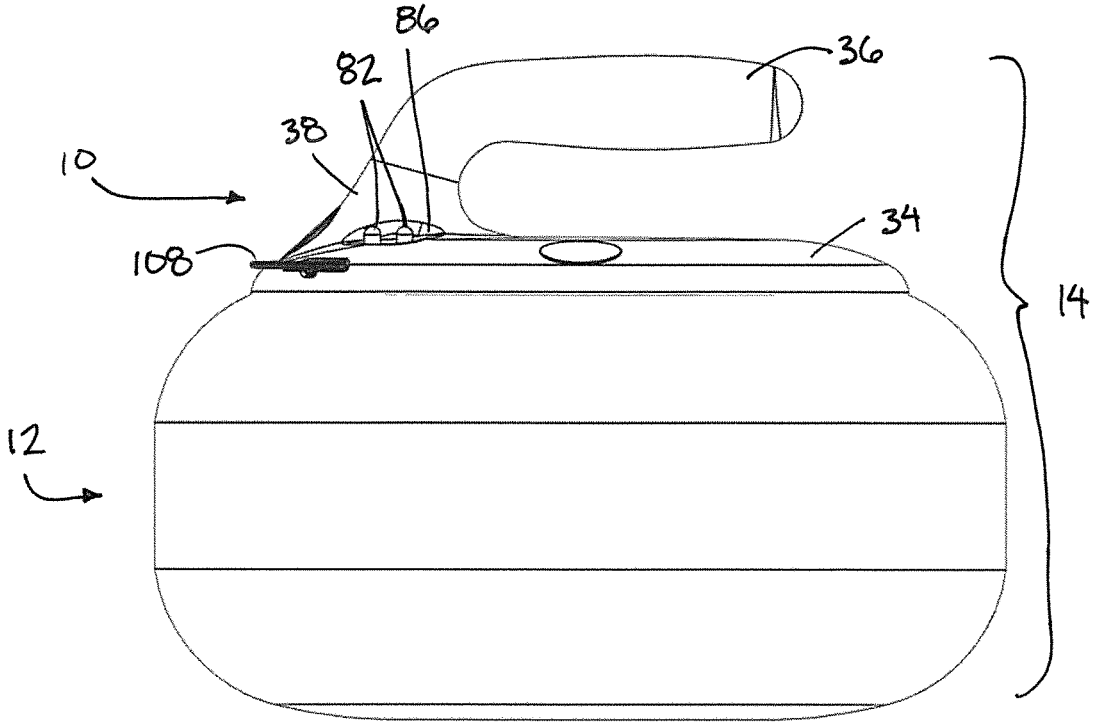
FIGS. 2,3 and 4 are side elevational, front elevational and top plan views of the curling stone according to FIG. 1 respectively.
Figure 3:
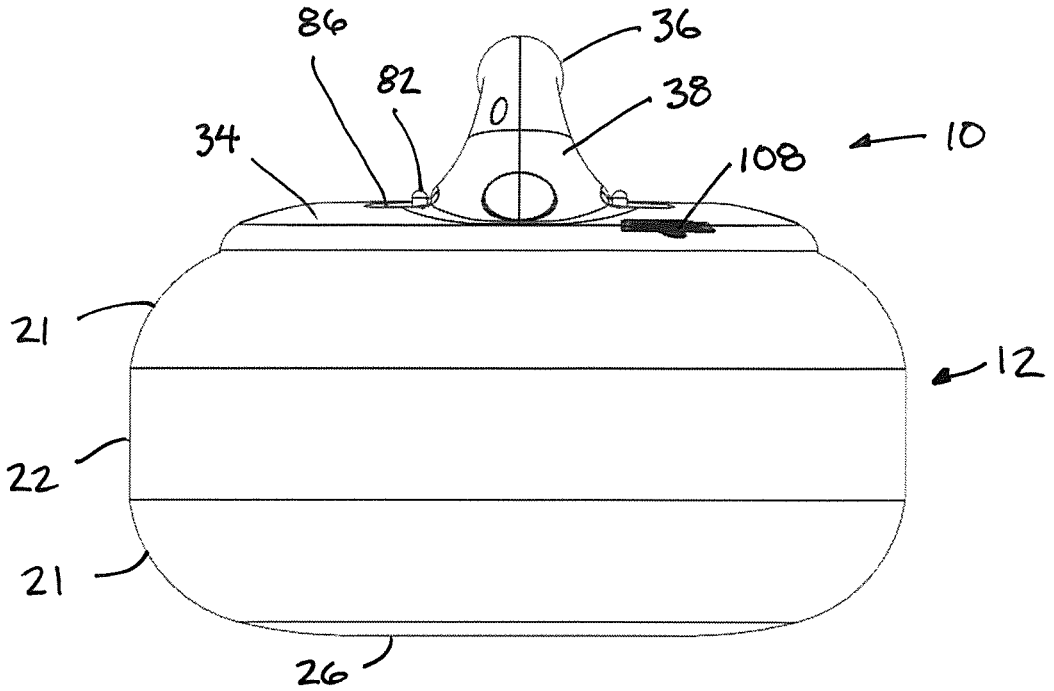
Figure 4:
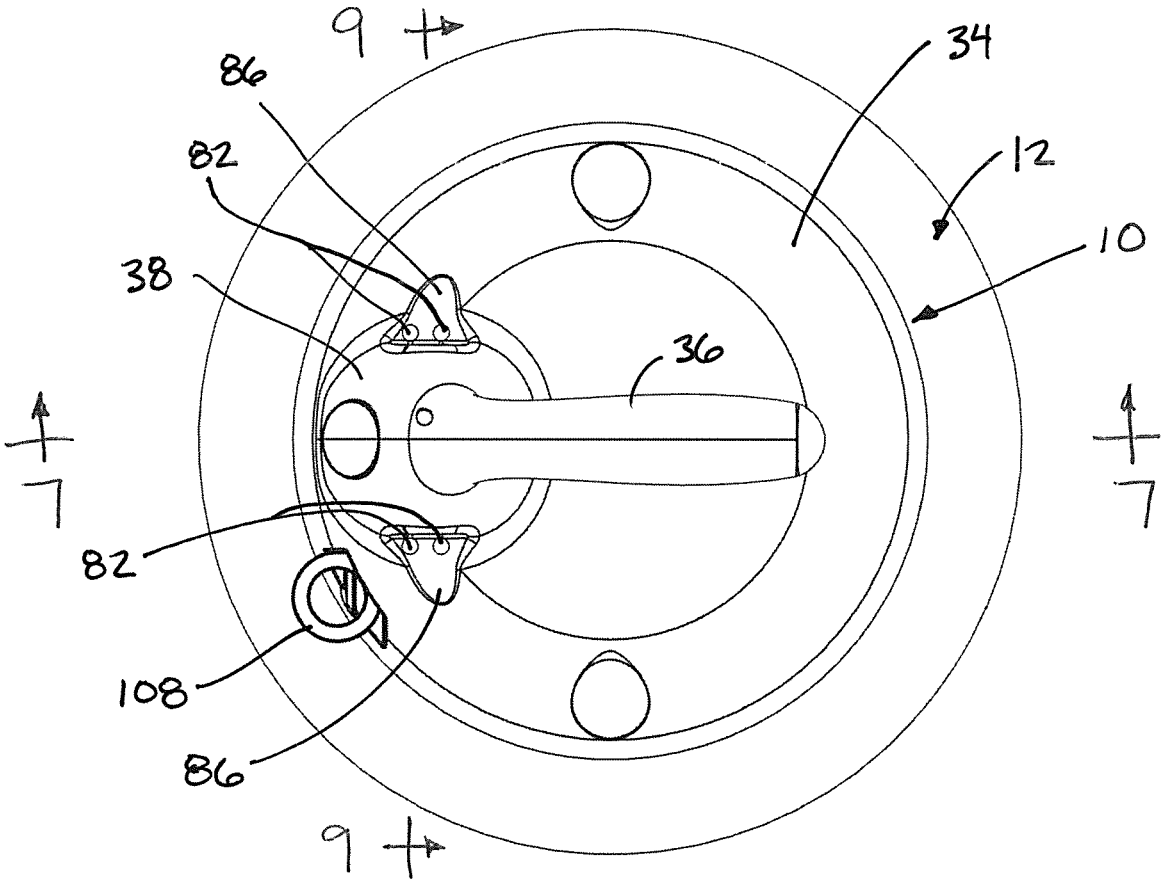
Figure 5:
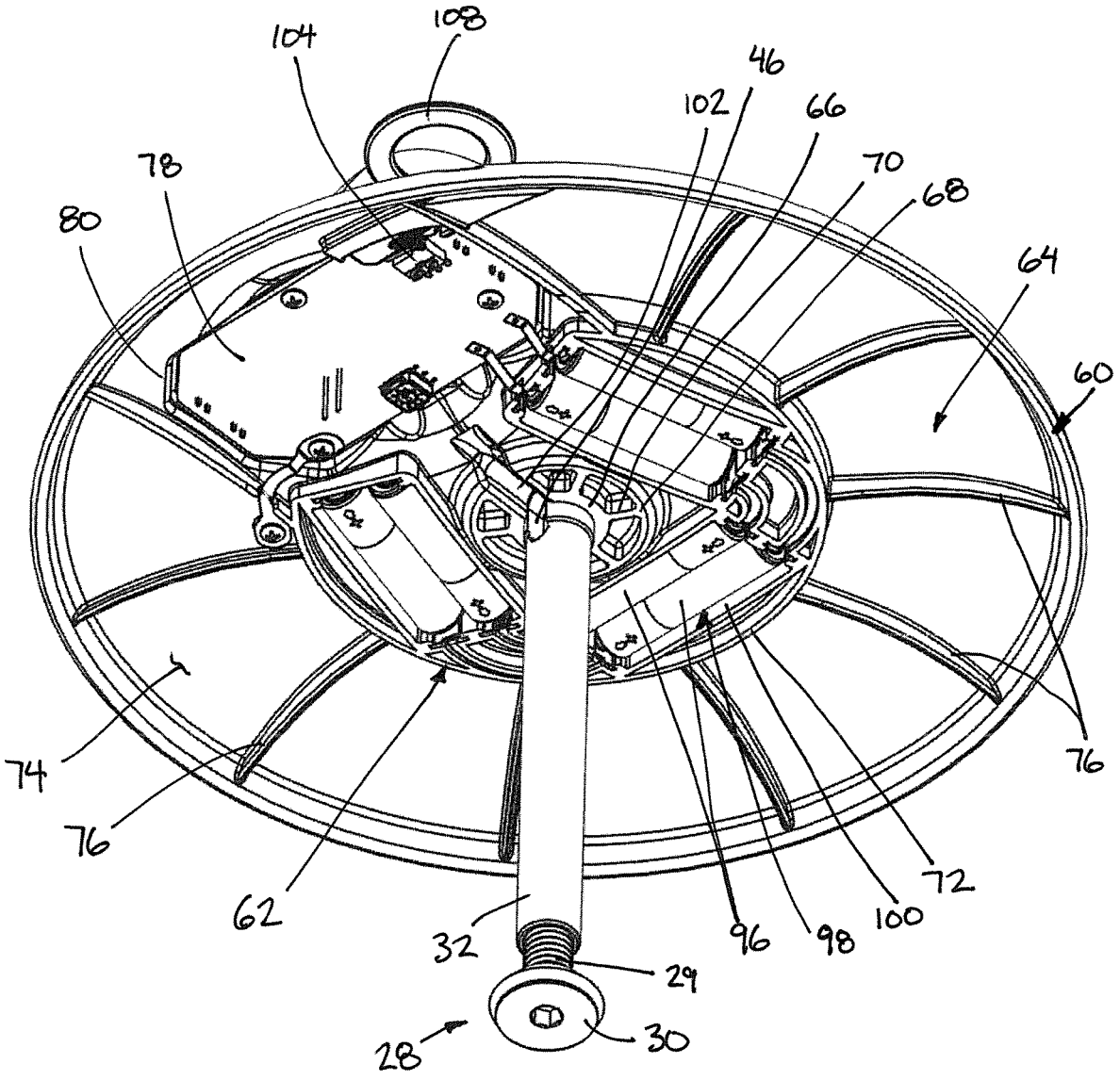
FIGS. 5 and 6 are different perspective views of a bottom side of the curling handle assembly shown separated from the stone body of a curling stone.
Figure 6:
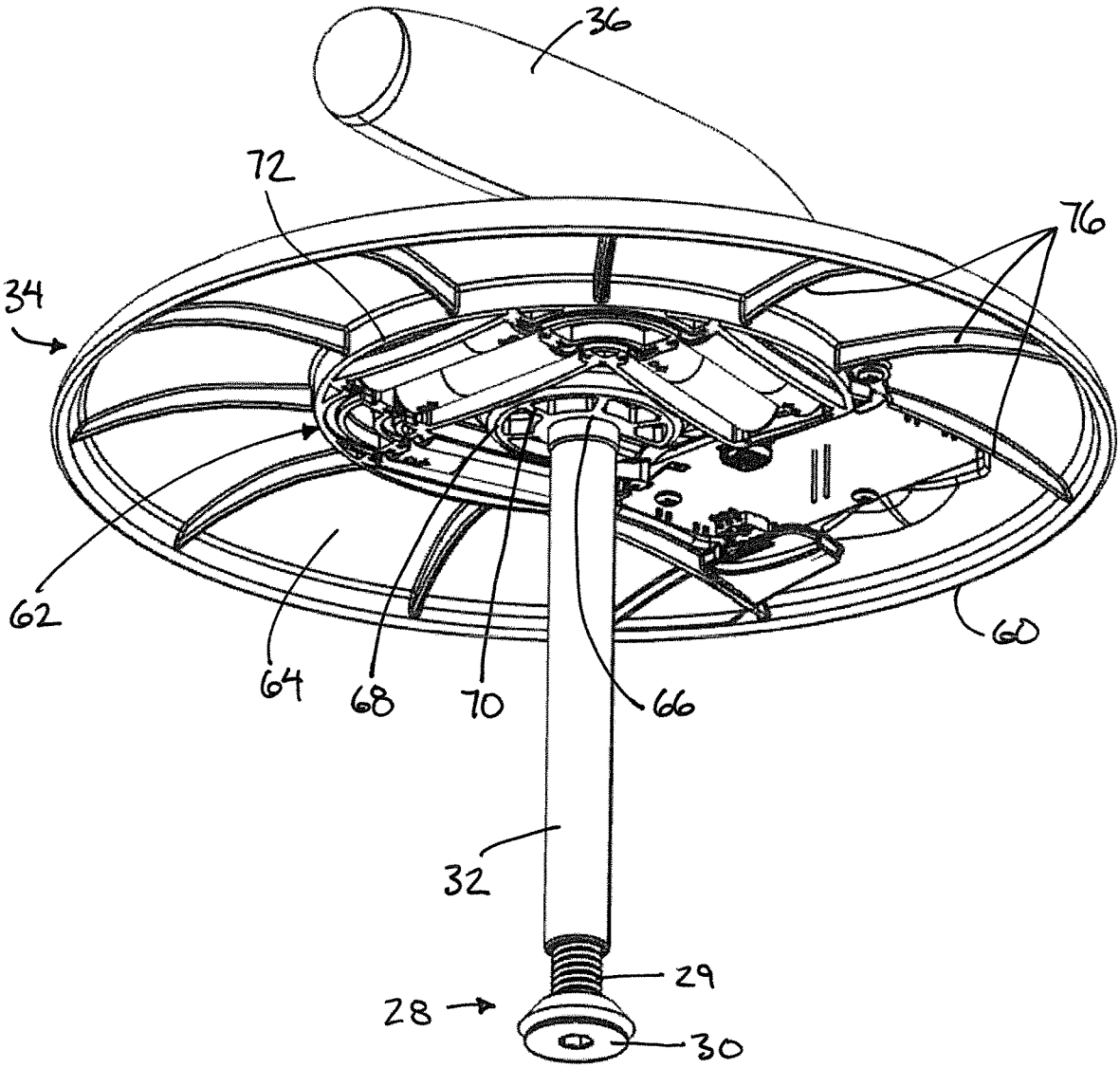

Referring to the accompanying figures, there is illustrated a curling handle assembly generally indicated by reference numeral 10. The curling handle assembly 10 is suited for connection to a stone body 12 to form a curling stone 14 of the type used in the sport of curling.

The stone body 12 of a curling stone is generally cylindrical in shape extending axially between a top end 16 and a bottom end 18 which are symmetrical with one another. A central mounting bore 20 extends axially through the stone body 12 between the top and bottom of the stone body in concentric alignment with the generally cylindrical shape of the body.

A junction between each of the top and bottom sides of the stone body with the cylindrical side of the stone body is shaped to form a rounded profile 21 such that a peripheral striking surface 22 that is cylindrical in shape is located centrally in the axial direction to be evenly spaced from each of the top and bottom sides of the stone body.

Each of the top and bottom ends of the stone body is further provided with a concave recess 24 in concentric alignment with the mounting bore 20 and the peripheral striking surface 22. An annular end surface 26 is provided at each of the top and bottom ends of the stone body such that the annular end surface lies perpendicular to the axial direction of the mounting bore 20 at a location surrounding the concave recess 24 at an inner boundary of the annular end surface. Each annular end surface 26 is spaced radially inwardly from the peripheral striking surface 22 about the circumference of the curling stone due to the rounded profile 21 at the junction between the cylindrical side of the stone body with each of the top and bottom ends of the stone body.

When the handle assembly is mounted against the top side of the stone body, the annular end surface 26 at the bottom side of the stone body functions as the running surface of the curling stone that engages the ice sheet for sliding along the ice during delivery of the curling stone in the sport of curling. The opposing annular end surface 26 at the top side of the stone body works together with the concave recess 24 and the rounded profile 21 at the top side of the stone body to collectively form a mounting surface at the top side of the stone body against which the handle assembly is clamped using threaded fasteners 28 in a mounted position of the handle assembly 10 onto the stone body 12 to form a curling stone 14. Due to the symmetrical relation between the top and bottom sides of the curling stone, the stone body can be inverted in an alternate use in which the annular end surface 26 previously located at the top of the stone body instead defines the running surface that engages the ice sheet for sliding along the ice during delivery of the curling stone while the handle assembly clamps against the stone body in the same manner opposite to the running surface that engages the ice sheet.

The threaded fastener 28 has a threaded shaft portion 29 and a head portion 30 of enlarged diameter relative to the shaft portion 29 at one end of the shaft portion. The shaft portion 29 of the threaded fastener is inserted upwardly into a bottom end of the mounting bore regardless of the orientation of the stone body. The enlarged head portion abuts a peripheral edge about the bottom end of the mounting bore within the corresponding concave recess 24 at the bottom of the stone body. A resilient gasket may also be provided between the head of the fastener and a mating counterbore at the bottom end of the mounting bore 20. The threaded shaft portion 29 forms a threaded connection with the handle assembly 10 such that tightening of the threaded connection between the fastener 28 and the handle assembly 10 will clamp the stone body between the handle assembly 10 above the stone body and the head portion 30 of the threaded fastener below the stone body.

The curling handle assembly 10 generally includes (i) a connector 32 that forms a threaded connection with the threaded fastener 28, (ii) a support body 34 extending outwardly from a top end of the connector and defining a lower contact surface for clamping against the mounting surface at the top side of the stone body in the mounted position of the handle assembly, (iii) a handle body 36 arranged to be gripped in a hand of a user, and (iv) a connector body 38 joined between one end of the handle body and the support body so as to support the handle body in fixed relation to the support body.

In the illustrated embodiment, the connector 32 is an elongate tube formed of a rigid, non-ferromagnetic material, for example a non-ferromagnetic metal. The remaining components such as the support body 34, the handle body 36 and the connector body 38 are molded integrally with one another of a unitary material, for example a rigid, molded, plastic material, so as to be seamless relative to one another. A top end of the connector 32 is joined to the remaining plastic body parts 34, 36 and 38 by placing the connector within an injection mold for forming the remaining plastic body parts such that the remaining plastic body parts are injection molded about the top end of the connector, resulting in the connector 32 being held in fixed relation to the remaining plastic body parts.

The rigid tube of the connector 32 has an overall height which is near to a height of the stone body between the top and bottom sides thereof at the location of the mounting bore 20. The rigid tube of the connector 32 has a hollow interior spanning the height of the tube between a top end 40 which is closed and an opposing bottom end which is arranged for mating connection with the threaded fastener 28. A peripheral flange 42 extends radially outwardly from the top end of the rigid tube about the full circumference thereof such that when the top end of the connector 32 is embedded within the mold and the resulting plastic material of the support body 34 surrounds the top end of the connector, the surrounding material interacts with the flange to prevent removal of the connector from the support body.

A central bore 44 extends axially through the rigid tube of the connector 32 so as to be open to the bottom end of the connector. The bore terminates adjacent the closed top end 40 of the connector. A wiring port 46 communicates radially through the wall of the connector 32 between the top end of the hollow interior defined by the bore 44 and the exterior of the connector 32 at a location immediately below the inner surface of the support body 34. The wiring port 46 thus communicates between the hollow interior of the connector 32 an enclosed space between the support body above and the top end of the stone body 12 therebelow.

A counterbore 48 having an internal diameter which is enlarged relative to the main bore 44 extends upwardly from the bottom end of the connector 32 in axial alignment with the main bore 44. In this manner, an annular shoulder is defined at an intermediate height along the hollow interior of the connector 32 between the terminal end of the counterbore 48 and the remainder of the bore 44 extending thereabove. The shoulder 50 is supported in close proximity to a centre of the stone body in the vertical direction between the opposing top and bottom sides thereof.

A central sensor 52 having an outer diameter that is greater than the inner diameter of the main bore 44 but which is smaller than the inner diameter of the counterbore 48 is received within the counterbore for abutment against the shoulder 50. A threaded plug 54 is inserted within the counterbore 48 with the external threads in mating connection with internal threads within the counterbore at a location immediately below the central sensor to retain the central sensor axially constrained between the shoulder 50 and the threaded plug 54. A remainder of the counterbore 48 below the threaded plug is also internally threaded to receive the threaded shaft 29 of the fastener 28 therein in a mounted position of the handle assembly 10 on the stone body of the curling stone.

The support body 34 defines the main structural body of the handle assembly that is clamped against the top side of the stone body in the mounted position. The support body is generally circular in shape, having an outer diameter which is greater than the outer diameter of the annular end surface 26 of the stone body such that a peripheral edge of the support body engages the top side of the stone body at the rounded profile 21 thereof.

The support body 34 includes a main body portion 56 having a top side which is generally convex in shape. More particularly a central portion of the main body 56 is generally flat and circular in shape, whereas a peripheral edge portion of the main body portion 56 has a smaller radius of curvature than the central portion so as to be curved radially outwardly and downwardly more aggressively than the central portion of the main body portion 56.

The underside of the support body 34 defines a lower contact surface that engages the top side of the stone body in a mounted position. The lower contact surface includes an annular portion 60 at the outer periphery of the support body, and a central portion 62 at a central location on the support body that is spaced radially inward from the annular portion 60.

Figure 7:
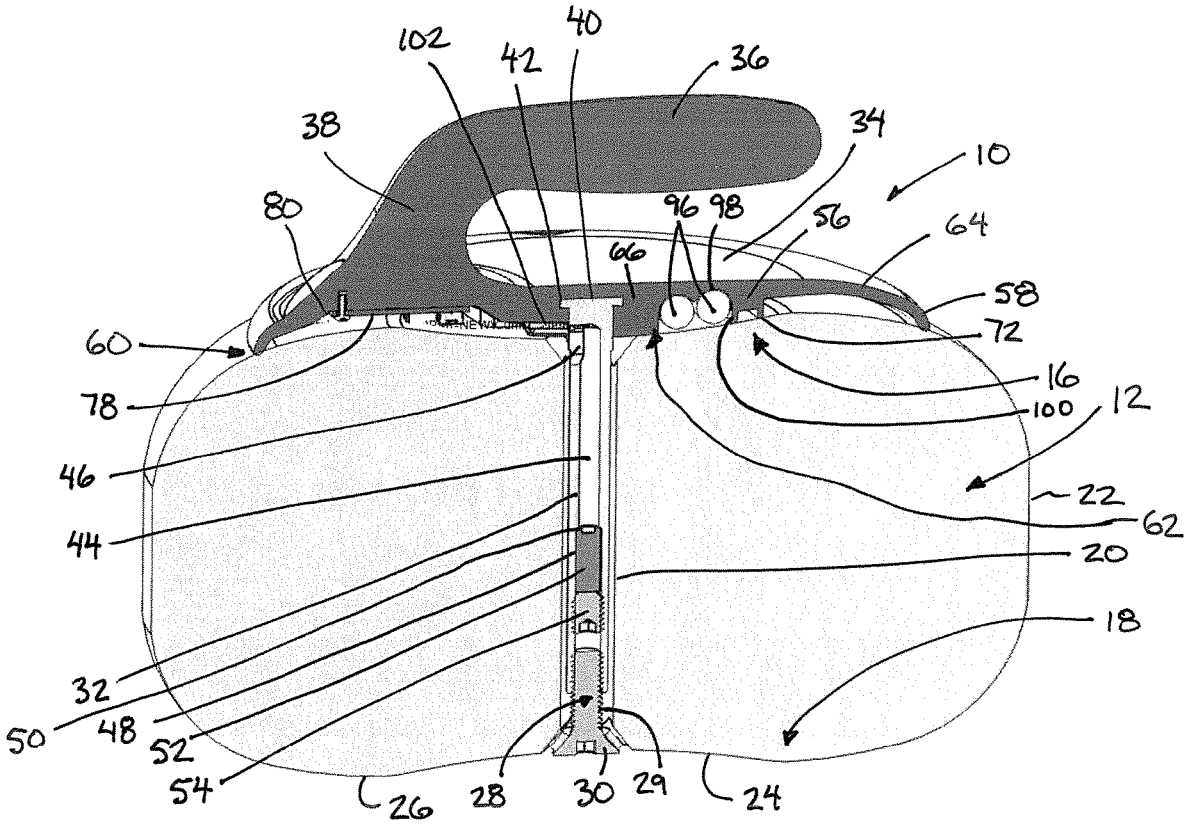
FIG. 7 is a sectional view of the curling handle assembly along the line 7-7 in FIG. 4.
Figure 8:
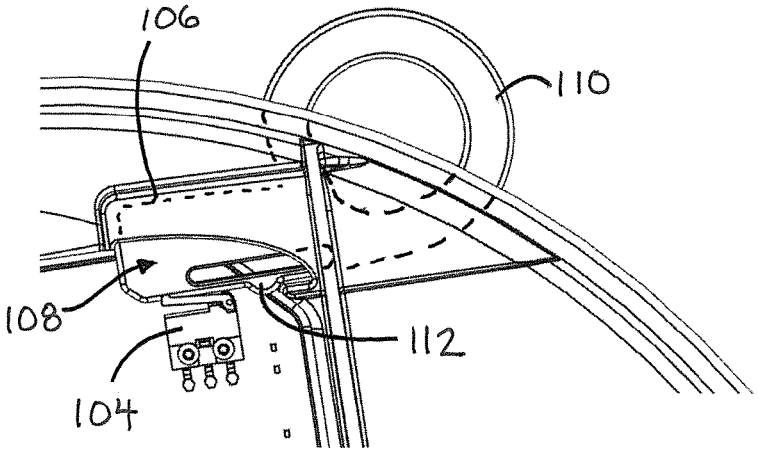
FIG. 8 is a bottom view of a portion of the curling handle assembly illustrating the interrupt switch.
Figure 9:
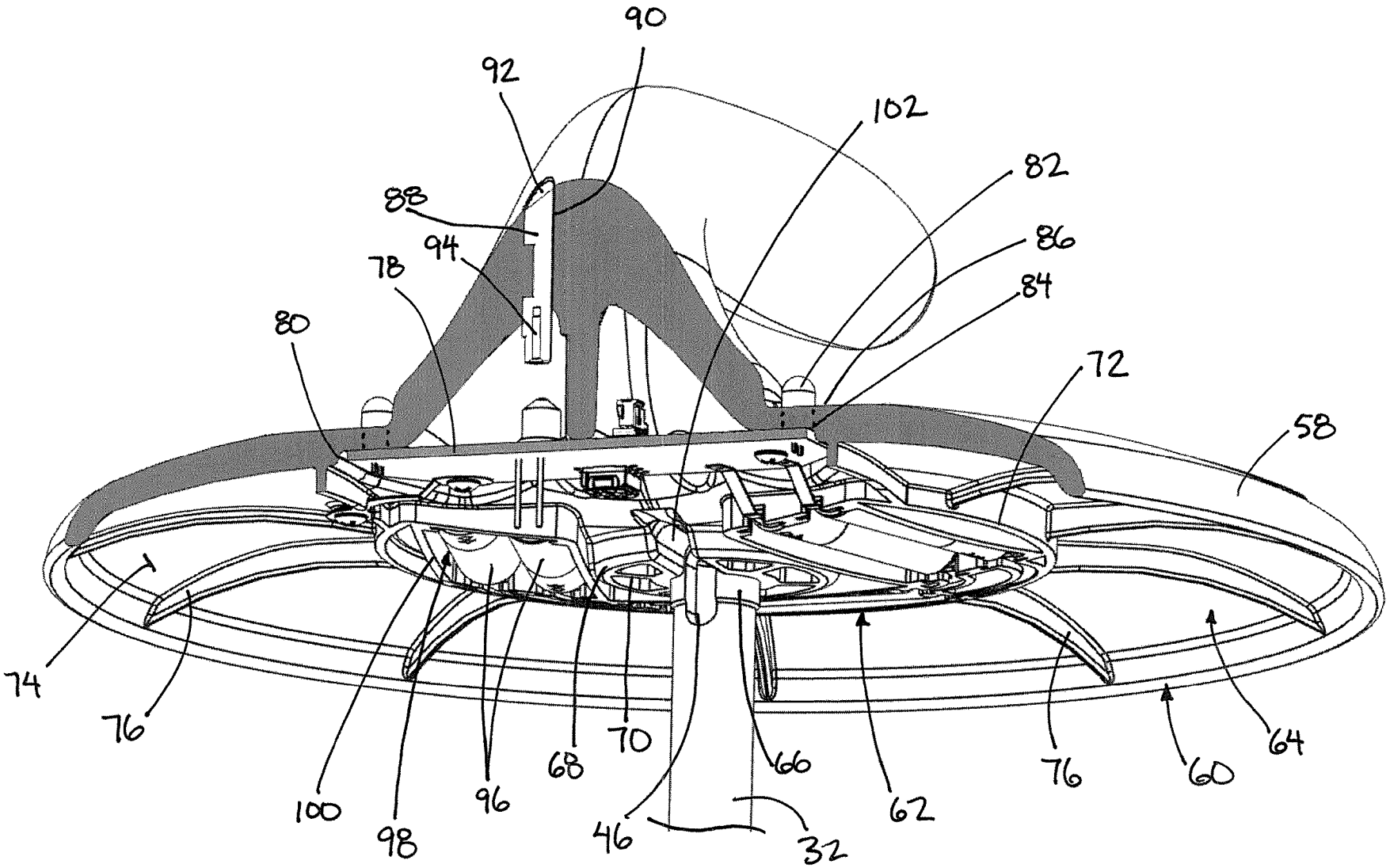
FIG. 9 is a sectional view of the curling handle assembly along the line 9-9 in FIG. 4.

The annular portion 60 of the lower contact surface of the support body corresponds to the bottom edge of the downwardly protruding edge portion 58 of the support body that is annular in shape and that extends about the circumference of the support body 34. The annular portion of the lower contact surface is arranged to form first contact of the support body with the top side of the stone body as the support body is clamped against the top side of the stone body by the threaded fastener in the mounted position of the assembly. For example, as illustrated in FIG. 7, the annular portion 60 of the lower contact surface of the support body is illustrated in interference with the top side of the stone body at the rounded profile 21 thereof in order to cause the remaining components defining the central portion 60 of the lower contact surface at the bottom of the support body to engage the corresponding portions at the top side of the stone body. In actual use, the annular portion 60 cannot penetrate into the stone body as illustrated and the support body 34 undergoes flexion as described in further detail below.

The components forming the central portion 62 of the lower contact surface of the support body 34 collectively define a convex lower boundary that matches the curvature of the concave recess 24 at the top side of the stone body. In order for the convex lower boundary of the central portion 62 to make contact with the corresponding concave recess 24 at the top side of the stone body, a peripheral portion 64 of the support body 34 that spans the annular gap between the central portion 62 of the lower contact surface and the annular portion 60 of the lower contact surface, must undergo some degree of flexion or resilient bending due to the interference between the annular portion 60 and the rounded profile 21 shown in FIG. 7.

The central portion 62 includes a central mass 66 surrounding the top end of the connector 32 and which terminates at a bottom end forming part of the convex lower boundary. A central rim 68 protrudes downwardly from the remaining inner surface of the support body so as to be circular in shape in concentric alignment with the central mass 66. A plurality of radial ribs 70 are connected radially between the central mass 66 and the central rim 68 at circumferentially spaced positions. The central mass 66, the ribs 70 and the central rim 68 all terminate together at the convex lower boundary of the support body. The support body 34 also includes an intermediate rim 72 in the form of a cylindrical shaped flange extending downward from a remaining inner surface of the support body in concentric alignment with the central rim 68 but at a location spaced radially outward therefrom. The intermediate rim also terminates at a bottom end thereof at the convex lower boundary of the central portion 62 of the support body 34.

The main inner surface 74 of the support body 34 between the central portion defined at the outer circumference thereof by the intermediate rim 72 and the annular portion 60, corresponding to the peripheral portion 64 of the support body, is raised upwardly relative to the convex lower boundary of the central portion of the lower contact surface and the annular portion 60 of the lower contact surface. The main inner surface 74 of the peripheral portion 64 generally follows the profile of the outer surface of the support body 34 which is curved downwardly and outwardly at the edge portion 58 of the support body.

A plurality of radial stiffener ribs 76 are also provided as part of the support body 34 at the location of the peripheral portion 64. The ribs 76 each extend radially across an intermediate portion of the support body between the intermediate rim 72 and the annular portion 60 at the outer periphery of the support body 34. Each rib protrudes downwardly from the remaining main inner surface 74. The ribs are evenly spaced apart in the circumferential direction about a majority of the peripheral portion 64, however, an enlarged gap is provided between the ribs at the front of the handle assembly as described in further detail below. Within the current description, the front of the handle assembly corresponds to the mounting location of the handle body 36 relative to the support body 34 using the connector body 38. As shown in the figures, the annular portion of the lower contact surface is formed at the bottom edge of the downwardly protruding edge portion 58 at the outer periphery of the support body, and each radial stiffener rib terminates at an outer end at an inner surface of the downwardly protruding edge portion 58.

The ribs 76 provide stiffening to the peripheral portion 64 of the support body so as to increase the force required for the support body to undergo flexion caused by interference of the annular portion 60 with the rounded profile 21 when clamping the convex lower boundary of the central portion 62 against the concave recess 24 at the top of the stone body. Tightening of the threaded connection between the fastener 28 and the connector 32 causes the central portion to be pulled into engagement with the top side of the stone body as the peripheral portion 64 of the support body undergoes flexion. In this manner, even as the fastener loosens over time resulting in the convex lower boundary of the central portion 62 becoming separated from or less firmly engaged upon the top side of the stone body, the flexion of the peripheral portion 64 maintains the annular portion 60 of the support body in firm clamping engagement against the corresponding rounded profile 62 at the top side of the stone body.

By maintaining some clamping friction of the annular portion 60 of the support body 34 engaged upon the top side of the stone body at a location spaced radially outward by a considerable distance from the central axis of the stone body, the support body 34 remains fixed in orientation relative to the stone body even as the support body undergoes considerable rotational forces about the upright central axis of the fastener 28 relative to the stone body. This prevents the handle assembly 10 from being inadvertently pivoted relative to the stone body as a user applies rotation to the curling stone during a delivery of the curling stone to a much greater degree than prior art clamping arrangements which rely only on a small portion of the support body immediately surrounding the top end of the connector to apply frictional resistance against rotation between the handle assembly 10 and the stone body.

The handle body 36 is an elongate somewhat cylindrical body which is suitably sized to be readily gripped in one hand of a user. The opposing ends of the handle body are somewhat rounded such that the handle body has an ergonomic shape which is somewhat elliptical in profile so that the overall shape of the handle body defines an ellipsoid or cigar shape. The handle body is supported at the front end thereof on the connector body such that a long axis of the handle body extends rearwardly from the front end to be generally horizontal in orientation at a location spaced above the central portion of the support body 34. The handle body 36 is generally centred in the longitudinal direction of the handle body relative to the mounting bore of the stone body and the connector 32 of the assembly 10 therebelow.

The connector body 38 is generally conical in shape so as to be wider at the bottom end thereof where it is joined to the support body 34 while being narrower at the top end thereof to be similar in diameter with the front end of the handle body 36 to which it is joined. The connector body 38 connects the handle body 36 to the support body 34 such that the bodies are all in fixed relation to one another as a single, unitary, seamless mass of molded plastic material.

An electronic assembly of numerous components is supported primarily on the support body, but also partly within the connector body and/or the handle body of the handle assembly 10. Corresponding cavities are formed in the plastic material during the molding step to receive the various components of the electronic assembly therein.

The main component of the electronic assembly is a printed circuit board 78 that includes a memory for storing programming instructions thereon and a processor for executing the programming instructions to perform the various functions required of the electronic assembly. The printed circuit board thus acts as a main controller that controls the functioning of the curling handle assembly 10. A main controller cavity 80 is formed in the underside of the support body 34 to receive the printed circuit board therein. The main controller cavity is generally rectangular in shape to correspond to the shape of the printed circuit board and is located at the front of the support body directly below the connector body 38. The cavity is open to the bottom of the support body and is recessed upwardly into underside of the support body relative to the main inner surface 74 of the support body. The main controller cavity 80 is bound at laterally opposing sides by a corresponding pair of the radial stiffener ribs 76 which form the enlarged gap between adjacent ones of the ribs in the circumferential direction.

The printed circuit board supports a plurality of indicator lights 82 in the form of LED bulbs protruding upwardly from the top side of the printed circuit board. When the printed circuit board is received within the main controller cavity 80, the indicator lights 82 align with respective indicator cavities 84 integrally molded into the support body. Each indicator cavity comprises a bore extending upwardly through the support body between the upper and lower surfaces thereof. Due to the main controller cavity receiving the printed circuit board thereof, the remaining material between the top side of the printed circuit board that is mounted within the cavity and the top side of the support body at the location of the indicator cavities is quite small, enabling the indicator lights 82 to protrude upwardly beyond the surrounding exterior surface of the support body about each of the indicator cavities 84.

The top surface of the support body 34 is joined to the base of the connector body 28 in proximity to the indicator cavities 84. To enhance the visibility of the indicator lights 82, the conical surface of the connector body at the junction with the support body forms a pair of indicator recesses 86 at laterally opposing sides in which each indicator recess includes two indicator cavities 84 aligned therewith. At each indicator recess 86, the conical surface of the connector body is notched so that an upper surface portion surrounding the respective pair of indicator lights is near horizontal and recessed in elevation relative to the light switch protrude upwardly from the top surface for visibility from multiple directions.

The handle assembly is further provided with a touch sensor that includes an embedded electrode 88 supported within a respective electrode cavity 90 in the connector body 38 in proximity to the front end of the handle body 36. The electrode cavity is moulded into the connector body 38 at the time of manufacture. The embedded electrode 88 is an elongate generally cylindrical body having a top end 92 which is sloped to match the slope of the exterior surface of the connector body. The bottom end 94 of the embedded electrode protrudes downwardly from an inner surface of the connector body at the underside of the handle assembly. The bottom end is connected by suitable wiring to the printed circuit board for communication therebetween. As shown in the figures, the electrode cavity 90 includes an open end that is open to the exterior surface of the connector body 38 and the embedded electrode 88 is embedded with the electrode cavity 90 to extend fully through the connector body between an outer end face of the embedded electrode that is open to the exterior surface of the receiving body and an inner end of the embedded electrode protruding below an inner surface at an underside of the connector body. The embedded electrode is conductive between the outer end face and the inner end of the embedded electrode and the outer end face is supported at the open end of the electrode cavity at the exterior surface of the connector body such that the outer end face is in conductive contact with the conductive coating on the handle body.

The cylindrical body of the electrode 88 is non-continuous in profile along the length thereof so as to include a middle portion with a different outer diameter than two opposing end portions of the electrode. In the illustrated embodiment, the middle portion includes a groove formed about part of the circumference to define a reduced diameter. In this manner when the electrode 88 is embedded into the mould that the connecting body is moulded in, the moulded plastic material protrudes into the groove formed in the middle portion acting to support the embedded electrode 88 non-removably within the electrode cavity 90. A conductive coating is provided about the exterior of the handle body 36 and is in conductive contact with the top end 92 of the conductive electrode 88. In this manner the coating on the handle body is conductively connected to the printed circuit board through the embedded electrode 88. The circuitry on the printed circuit board is arranged to detect a change in capacitance of the touch sensor as a result of the hand of a user touching the conductive coating on the handle.

The electronic assembly further includes a set of batteries 96 which are received within respective battery cavities 98 that are also integrally moulded into the support body at the time of moulding. In the illustrated embodiment, six conventional batteries are provided within three cavities such that each of the three battery cavity receives a pair of the conventional cylindrical shaped batteries therein. More particularly each battery cavity comprises a perimeter wall 100 protruding downwardly from the main inner surface of the support body to form a battery cavity boundary sized to receive a pair of the batteries 96 therein. As shown in the figures, the battery cavities 98 are spaced radially outward from a central axis of the connector 32 that mounts in the central bore of the curling stone. The battery cavities are further spaced circumferentially from one another about the central axis of said connector. As shown more particularly in FIG. 7, each battery cavity is open at a bottom side of the cavity to receive the batteries inserted therein, and each battery cavity is located within the support body such that the open bottom side is enclosed by the stone body when the curling handle assembly is mounted on the stone body.

The perimeter walls 100 span the full height of the cavity such that the bottom edges of the perimeter walls of the battery cavities terminate within the lower convex boundary of the central portion of the lower contact surface of the support body 34. The cavity has a depth which is recessed upwardly relative to the lower convex boundary by a diameter of the batteries such that the batteries are fully recessed above the lower boundary of the central portion of the lower contact surface of the support body that engages the top side of the curling stone body.

Each of the battery cavities is located within the annular space between the central rim 68 and the intermediate rim 72 of the central portion of the support body. Suitable channels are also integrally formed within the support body 34 above the lower convex boundary and within the boundary of the intermediate rim 72 to receive conductive connections between all of the batteries and the printed circuit board for supplying electrical power from the batteries to the printed circuit board. Spring contacts are provided within the battery cavities to retain the batteries within the cavities under spring pressure while enabling the batteries to be readily releasable and interchanged as desired. In further embodiments, rechargeable batteries may be used in various forms which are either replaced or charged in situ.

The central rim 68 includes a wiring cavity 102 formed therein which communicates radially from the wiring port 46 at the top end of the connector 32 in a forward direction towards the controller cavity and the printed circuit board received therein. This enables conductive wiring to be communicated from the printed circuit board, through the wiring cavity 102, through the wiring port 46, and through the hollow bore extending axially through the connector 32 to the central sensor 52 within the connector. In this manner the central sensor communicates with the printed circuit board.

The central sensor 52 may comprise a magnetic sensor supported within the connector 32 which is formed of a non-ferromagnetic material so as not to interfere with the magnetic sensor function. The central sensor 52 may also include a motion sensor such as, but not limited to, an accelerometer and/or angular velocity sensor. The sensor may also include its own microcontroller as well. The central sensor can cooperate with external sensors provided on a curling sheet for the sport of curling so that the central sensor can interact with the positional indicators on the curling sheet to determine position and/or movement of the central sensor relative to the curling sheet. Location of the central sensor within the mounting bore ensures that the sensor is located at a true centre of the stone body for optimal measurement of the position and movement of the curling stone.

The printed circuit board is further provided with a variety of sensors including accelerometers, gyroscopic sensors, and the like for tracking the rate of rotation and angular acceleration of the curling stone, and/or the linear acceleration and deceleration of the curling stone along the ice sheet, for measuring and determining various performance characteristics of the curling stone. The collection of sensors communicating with the printed circuit board collectively define a sensor circuit for sensing data and communicating the data externally to users, for example through the indicator lights, or through a wireless antenna provided on the printed circuit board to communicate data wirelessly to external devices.

In order to preserve battery life, an interrupt switch is provided on the circuit board to interrupt the communication between the battery and most of the main controller defined by the printed circuit board, including the sensor circuit. The interrupt switch 104 is mounted on the printed circuit board in close proximity to a keyhole cavity 106 that is formed in the support body at the time of moulding. The keyhole cavity is a channel that communicates generally horizontally from an inner end in open communication with the controller cavity locating the printed circuit board therein to an outer end at the exterior of the support body in proximity to the outer periphery thereof. The keyhole cavity 106 is suitably shaped to slidably receive and interrupt key 108 therein in which the shaft of the key has a cross-sectional shape corresponding to the cross-sectional shape of the channel such that the corresponding profiles only meet with one another in a single relative orientation. The key also includes an enlarged handle 110 at the outer end of the shaft which acts as a stop which prevents over insertion of the key into the keyhole cavity.

The interrupt key 108 is movable between an engaged position and a disengaged position. The engaged position, the shaft is fully inserted within the keyhole cavity such that the shaft engages the interrupt switch 104 to the press the lever of the interrupt switch. The interrupt key is slidably removable from the support body as it is longitudinally slidable within the channel from the engaged position to the disengaged position. In the disengaged position, the interrupt key is fully separated from the support body 34. Accordingly in the disengaged position, the key is separated from the interrupt switch and the lever of the interrupt switch returns to an undepressed position under biasing of a spring.

In this manner, the interrupt switch is activated by insertion of the key into the engaged position such that in the activated position the switch is opened for interrupting communication between the battery and the sensor circuits of the printed circuit board. In this instance, the interrupt switch is a mechanical switch which interrupts connection between the battery and the sensor circuits and the controller circuits. To do that, the switch shall be a Normally Closed type switch. This means, when the key is removed into the dis-engaged position the switch is closed and conducts current from the battery to electrical circuits. When the key is inserted into the engaged position, the interrupt switch is opened and disconnects the battery from the electrical circuits.

Alternatively, the interrupt switch is inactive when the key is removed into the disengaged position such that the interrupt switch in the inactive position is closed to allow communication of the batteries with the sensor circuits of the printed circuit board.

In yet further arrangements, the switch itself doesn't provide the power from the battery to the electrical circuits. The interrupt switch in this case generates a command signal to the electronic power circuit of the controller to provide instruction to connect or disconnect the battery from the electronic circuits of the handle. In this case the switch itself can be either Normally Open or Normally Closed.

The shaft of the interrupt key includes a spring clip portion 112 having an arm which can be resiliently deflected and a protrusion on the arm protruding beyond the boundary of the shaft of the key in undeflected position. In this manner insertion of the key requires the protrusion to flex the spring arm inwardly. Once the key has been fully inserted however, the protrusion aligns with an open recessed area of the channel which allows the spring arm to return to an undeflected position and thereby retain the key fully inserted in the engaged position. Subsequent removal of the key from the engaged position to the disengaged position requires application of sufficient force that exceeds the holding force of the key so as to cause the protrusion to be deflected inwardly to flex the ring arm inwardly sufficiently that the protrusion is contained within the boundary of the profile shape of the key shaft.

The programming stored on the printed circuit board collects data from the various sensors, then stores the data and/or communicates the data externally to accomplish the various required functions of the curling stone. In one instance, the controller is arranged to determine if the curling stone has been released by a player before the curling stone crosses a designated hog line on the ice curling sheet. In order to make this determination, the controller uses sensors noted above to detect position of the stone relative to the hog line on the curling ice sheet and as well uses the embedded electrode 88 to determine by varying capacitance when a user has released the conductive coating on the handle body. If the curling stone is determined to have been released before crossing the designated line, the controller will illuminate the indicator lights with a green colour to communicate a successful delivery; however, if contact with the curling stone is determined after the curling stone crosses the designated line, the controller will instead illuminate the indicator lights with a red colour to communicate an improper delivery.

The indicator lights can also be illuminated in various colours and blinking patterns to indicate different sensing modes or operating modes of the curling stone. When the printed circuit board is provided with a wireless antenna, the controller can also communicate wirelessly with portable electronic devices to allow users to change the operating mode or operating characteristics of the controller.

In order to manufacture the handle assembly, the connector 32 is initially formed of a first material for example a nonferromagnetic metal, separately from the other components described above. The connector 32 and the embedded electrode 88 are placed into a common mold for injection molding such that plastic material is injection molded into the mold to surround the top end of the connector 32 and to surround the embedded electrode 88 for example. Suitable plugs are also provided within the mold to form all of the various cavities for the electronics as described above including the indicator cavities, the battery cavities, the controller cavity, and the like.

The support body 34, the connector body 38 and the handle body 36 are all formed together in a single injection molding step such that these bodies are formed seamlessly with one another as a single unitary structure of common material throughout. Once removed from mold, the conductive coating is then applied to the exterior of the handle body in conductive communication with the outer end of the embedded electrode 88. Other electronics including the printed circuit board with the indicator lights supported thereon, are then installed within the respective cavities in the support body along with conductive connectors for batteries received within the battery connectors. The central sensor within the connector 32 is also mounted subsequent to molding with suitable wiring communicating through the wiring port and wiring cavity to the printed circuit board. In this manner, no drilling of the molded plastic material is required so as not to alter any internal stresses within the molded material and thus avoid any weakening of the structure of the curling handle assembly.

The structure of the curling handle assembly 10 described above has several advantages over the prior art. Most notably the structure of the support body 34 provides even clamping pressure between the support body and the topside of the stone body at the outer periphery thereof to ensure maximum frictional engagement between the support body and the stone body to resist relative rotational forces. The stiffener ribs at the underside of the support body do not contact the stone body as they are raised in relation to the annular portion or the central portion of the lower contact surface of the handle assembly but they do provide stiffness to the handle required for distribution of load onto the preloaded rim when the handle is mounted on the stone. The rim contacts the stone surface before the rest of the handle surfaces to create a friction vector on a far off distance from the handle sensor which increases friction momentum of the handle in relation to the stone.

The curling handle assembly 10 described herein is also notably distinguished from prior art arrangements by the various cavities preformed into the moulded plastic material of the support body and other parts for locating various components of the electronic assemblies therein. For example, the battery housing is an integral part of the handle. The battery housing can incorporate AAA batteries or those of other dimensions. The battery contacts are also embedded into the support body and provide connection between the batteries, the controller, and the sensors, and any other electronic components.

The connector 32 of the assembly is an integrated long mounting tube formed of nonferrous material that contains a sensor or other electronic circuits. This tube is a channel for wiring to the printed circuit board and is located in the geometrical centre of the handle. The embedded electrode for the touch sensor is integrated into the handle body and provides connection between the touch sensor and a conductive surface on the exterior of the handle body. The system can use primary or rechargeable batteries. In either instance a removable battery circuit interrupter key allows preservation of batteries from discharging when the curling stone is not in use or is in storage. The interrupter switch disconnects the batteries from the majority of the main controller circuit, including the sensor circuit. The electronic circuit of the handle may include an embedded RFID system for detection of position and/or tracking motion of the stone. The electronic circuit can also feature wireless communication with a base station for transmission of motion, linear and/or angular parameters of the handle, hog line crossing events of the handle, working parameters of the handle, and/or allow software updates from the base station back to the printed circuit board.

The electronic assembly may include a transmitting antenna supported on the printed circuit board, or within a respective antenna cavity molded within one of the bodies of the handle assembly. The transmitting antenna is arranged to transmit a wireless signal receivable by two or more antennas associated with the sheet of ice so as to be arranged to track a position of the curling stone relative to a length and a width of the sheet of ice and thus track motion of the curling stone. The antenna and associated transmitted signal may be an RFID antenna and signal, a Bluetooth™ antenna and signal, or any other type of wireless signal transmitted by antenna.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A curling handle assembly for mounting on a stone body to form a curling stone for use in a sport of curling, the stone body having a cylindrical peripheral surface, a running surface for sliding engagement on a sheet of ice at a bottom side of the stone body, a mounting surface on a top side of the stone body, and a mounting bore extending axially through the stone body between the top side and the bottom side of the stone body to receive a threaded fastener for clamping the handle assembly onto the top side of the stone body, the curling handle assembly comprising:

a connector arranged to be inserted into the mounting bore at the top side of the stone body for mating connecting with the threaded fastener in a mounted position of the handle assembly;

a support body extending outwardly from a top end of the connector and defining a lower contact surface for clamping against the mounting surface at the top side of the stone body in the mounted position of the handle assembly;

a handle body arranged to be gripped in a hand of a user;

a connector body joined between one end of the handle body and the support body so as to support the handle body in fixed relation to the support body; and an electronic assembly supported on one or more of the support body and the connector body, the electronic assembly being arranged for measuring at least one performance characteristic relating to use of the curling stone and for communicating the performance characteristic externally to a user;

the electronic assembly including a sensor circuit, a controller circuit, a battery, and an interrupt switch arranged to selectively interrupt connection of the battery to one or more of the controller circuit and the sensor circuit;

an interrupt key; and a key hole communicating through the support body between an interior side of the support body locating the interrupt switch thereon and an exterior side of the support body;

the key hole being arranged to receive the interrupt key inserted therein in an engaged position of the interrupt key such that the interrupt key engages the interrupt switch and the interrupt switch interrupts the connection between the battery and said one or more of the sensor circuit and the controller circuit in the engaged position of the interrupt key; and the interrupt key being slidably removable from the support body from the engaged position to a disengaged position of the interrupt key in which the interrupt switch does not interrupt the connection between the battery and said one or more of the controller circuit and the sensor circuit in the disengaged position of the interrupt key.

2. The curling handle assembly according to claim 1 further comprising:

the lower contact surface including an annular portion at a periphery of the support body and being arranged to form a first contact of the support body with the top side of the stone body as the support body is clamped against the stone body by the connector such that the support body undergoes flexion between the connector and the annular portion at the periphery of the support body;

a plurality of cavities integrally moulded into one or more of the handle body, the connector body or the support body, the plurality of cavities receiving a portion of the electronic assembly therein;

wherein the plurality of cavities includes a plurality of battery cavities integrally molded into the support body between the connector and the annular portion of the support body in which each battery cavity receives one or more of the batteries of the electronic assembly therein; and wherein the plurality of battery cavities are spaced radially outward from said connector and are spaced circumferentially from one another about a central axis of said connector; and wherein each battery cavity that is integrally mounted into the support body comprises perimeter walls protruding downwardly from an inner surface of the support body, in which a depth of each battery cavity defined by the perimeter walls is equal to a corresponding dimension of the batteries.

3. The curling handle assembly according to claim 1 further comprising:

the electronic assembly including a printed circuit board having a memory storing programming instructions thereon and a processor to execute the programming instructions stored on the memory; and the plurality of cavities including a main cavity integrally molded in a bottom side of the support body and receiving the printed circuit board therein.

4. The curling handle assembly according to claim 1 further comprising:

the electronic assembly including an embedded electrode and a conductive coating on the handle assembly conductively connected to the electronic assembly through the embedded electrode for sensing a user touching the handle body; and at least one cavity integrally moulded into one or more of the handle body, the connector body or the support body and receiving a portion of the electronic assembly therein, said at least one cavity including an electrode cavity integrally molded into a receiving body among the handle body and the connector body that receives the embedded electrode therein wherein the electrode cavity includes an open end that is open to an exterior surface of said receiving body;

the embedded electrode having an electrode body embedded with the electrode cavity in said receiving body to extend fully through the receiving body between (i) an outer end face of the embedded electrode open to said exterior surface of the receiving body and (ii) an inner end of the embedded electrode protruding below an inner surface at an underside of the handle assembly;

the embedded electrode being conductive between the outer end face and the inner end of the embedded electrode; and wherein the electrode body has a non-continuous profile along a length thereof between the outer end face and the inner end protruding below the inner surface, and wherein said receiving body is formed about the non-continuous profile of the electrode body such that the electrode body of the embedded electrode cannot be removed from the plastic material of said receiving body; and wherein the outer end face is supported at the open end of the electrode cavity at the exterior surface of said receiving body in conductive contact with the conductive coating.

5. The curling handle assembly according to claim 4 wherein the outer end face of the embedded electrode has a slope matching a slope of a portion of the exterior surface of said receiving body surrounding the open end of the electrode cavity.

6. The curling handle assembly according to claim 1 further comprising a plurality of cavities integrally moulded into one or more of the handle body, the connector body or the support body, the plurality of cavities receiving a portion of the electronic assembly therein, wherein:

the electronic assembly includes an indicator light arranged to communicate the measured characteristic externally of the curling stone;

the plurality of cavities include an indicator bore communicating through the support body in proximity to the connector body from an inner surface of the support body to an outer surface portion of the support body surrounding the indicator light;

the indicator light protrudes upwardly in relation to said outer surface portion of the support body; and the outer surface portion of the support body that surrounds the indicator light is substantially horizontal in orientation.

7. The curling handle assembly according to claim 2 wherein the battery cavities are open at a bottom side to receive one or more batteries therein and wherein the battery cavities are located within the support body such that the open bottom side is enclosed by the stone body when the curling handle assembly is mounted on the stone body.

8. The curling handle assembly according to claim 7 wherein each battery comprises a cylindrical shaped battery and wherein each battery cavity is arranged to receive said one or more of the batteries therein such that the batteries are readily releasable from the battery cavities when the curling handle assembly is removed from the stone body.

9. The curling handle assembly according to claim 1 further comprising:

the lower contact surface of the support body including an annular portion that is annular in shape at a location spaced radially outward from the connector; and the annular portion of the lower contact surface being arranged so as to form a first contact of the support body with the top side of the stone body as the support body is clamped against the top side of the stone body by the threaded fastener in the mounted position.

10. The curling handle assembly according to claim 9 wherein the annular portion of the lower contact surface is located adjacent a peripheral edge of the support body.

11. The curling handle assembly according to claim 9 wherein the lower contact surface further includes a central portion about the connector at a location spaced inwardly from the annular portion, the support body between the annular portion of the lower contact surface and the central portion of the lower contact surface undergoing a resilient flexion when the central portion of the lower contact surface engages the top side of the stone body.

12. The curling handle assembly according to claim 9 further comprising a plurality of stiffener ribs formed on the support body to extend radially between the central portion of the lower contact surface and the annular portion of the lower contact surface at circumferentially spaced apart positions about the central portion.

13. The curling handle assembly according to claim 1 further comprising a plurality of cavities integrally moulded into one or more of the handle body, the connector body or the support body, the plurality of cavities receiving a portion of the electronic assembly therein, wherein the electronic assembly includes a transmitting antenna received within the plurality of cavities, the transmitting antenna being arranged to transmit a wireless signal receivable by two or more antennas associated with the sheet of ice so as to be arranged to track a position of the curling stone relative to a length and a width of the sheet of ice.

14. The curling handle assembly according to claim 1 wherein:

the support body comprises: (i) a central portion about the connector at a location spaced inwardly from the annular portion and extending downwardly to the lower contact surface, (ii) a main inner surface spanning an underside of the support body between the central portion and an outer periphery of the support body, in which said main inner surface is raised upwardly relative to the central portion, (iii) an annular portion at the outer periphery of the support body, in which the annular portion is annular in shape and protrudes downwardly from said main inner surface of the support body, (iv) a plurality of stiffener ribs formed on the support body to protrude downwardly from said main inner surface at circumferentially spaced apart positions about the central portion such that each stiffener rib extends radially from the central portion to the annular portion at the outer periphery of the support body;

the annular portion of the lower contact surface is arranged to form a first contact of the support body with the top side of the stone body as the support body is clamped against the top side of the stone body by the threaded fastener in the mounted position; and a peripheral portion of the support body between the annular portion of the lower contact surface and the central portion of the lower contact surface undergoing a resilient flexion when the central portion of the lower contact surface engages the top side of the stone body in which the stiffener ribs span the peripheral portion of the support body between the central portion and the annular portion.

15. The curling handle assembly according to claim 14 wherein the annular portion of the lower contact surface is formed at a bottom of a downwardly protruding edge portion at the outer periphery of the support body and wherein each radial rib terminates at an outer end at an inner surface of the downwardly protruding edge portion.

* * * * *